US009127562B2

(12) United States Patent
Raible

(10) Patent No.: US 9,127,562 B2
(45) Date of Patent: Sep. 8, 2015

(54) ROTOR OF A TURBOMACHINE

(75) Inventor: Tilmann Raible, Oberhausen (DE)

(73) Assignee: MAN Diesel & Turbo SE, Augsburg (DE)

( * ) Notice: Subject to any disclaimer, the term of this patent is extended or adjusted under 35 U.S.C. 154(b) by 766 days.

(21) Appl. No.: 13/497,033

(22) PCT Filed: May 25, 2010

(86) PCT No.: PCT/DE2010/050029

§ 371 (c)(1), (2), (4) Date: May 17, 2012

(87) PCT Pub. No.: WO2011/032548

PCT Pub. Date: Mar. 24, 2011

(65) Prior Publication Data

US 2012/0230826 A1 Sep. 13, 2012

(30) Foreign Application Priority Data

Sep. 18, 2009 (DE) ..... 10 2009 029 587

(51) Int. Cl.
*F01D 5/22* (2006.01)
*F01D 5/14* (2006.01)

(52) U.S. Cl.
CPC ..... *F01D 5/225* (2013.01); *F01D 5/143* (2013.01); *F05D 2240/80* (2013.01)

(58) Field of Classification Search
CPC ..... F01D 5/225
USPC ..... 416/191, 189, 190, 193 A, 182, 500, 416/193 R
See application file for complete search history.

(56) References Cited

U.S. PATENT DOCUMENTS

| | | | | |
|---|---|---|---|---|
| 3,185,441 | A | 5/1965 | Reuter | |
| 3,923,420 | A * | 12/1975 | Chifos | 416/190 |
| 4,400,915 | A | 8/1983 | Arrigoni | |
| 5,001,830 | A * | 3/1991 | Partington et al. | 29/889.21 |
| 5,154,581 | A | 10/1992 | Borufka et al. | |
| 2002/0071764 | A1 | 6/2002 | Turnquist et al. | |
| 2008/0145227 | A1 * | 6/2008 | Maier et al. | 416/193 R |
| 2009/0191053 | A1 * | 7/2009 | Bridge et al. | 415/208.2 |

FOREIGN PATENT DOCUMENTS

| | | |
|---|---|---|
| DE | 1 159 965 | 8/1961 |
| DE | 40 15 206 | 10/1991 |
| GB | 1503453 | 3/1978 |
| GB | 2 072 760 | 10/1981 |

(Continued)

*Primary Examiner* — Dwayne J White
*Assistant Examiner* — Justin Seabe
(74) *Attorney, Agent, or Firm* — Cozen O'Connor

(57) ABSTRACT

Rotor having of rotor blades. Every rotor blade has a blade body and coupling segment. A width of the coupling element segment is defined in circumferential direction by edges extending in axial direction. The coupling segment is contoured at a first side such that, on the flow inlet side to a flow inlet edge, the radially outer edge projects beyond the radially inner edge in axial direction. At this side on the flow outlet side of the blade body, the radially inner edge projects beyond the radially outer edge. The coupling segment is contoured at a second side such that, adjacent on the flow outlet side to the flow outlet edge, the radially outer edge extending in axial direction projects beyond the radially inner edge in axial direction. At, this second side facing away from the flow inlet edge the radially inner edge projects beyond the radially outer edge.

15 Claims, 7 Drawing Sheets

(56) References Cited

FOREIGN PATENT DOCUMENTS

| | | |
|---|---|---|
| GB | 2 139 295 | 11/1984 |
| JP | 07-180505 | 7/1995 |
| JP | 09-72202 | 3/1997 |
| JP | 2003-97216 | 4/2003 |
| JP | 2003-343280 | 12/2003 |

* cited by examiner

ROTOR OF A TURBOMACHINE

CROSS REFERENCE TO RELATED APPLICATIONS

This is a U.S. national stage of application No. PCT/DE2010/050029, filed on 25 May 2010. Priority is claimed on German Application No. 10 2009 029 587.9, filed 18 Sep. 2009, the content of which is incorporated here by reference.

BACKGROUND OF THE INVENTION

1. Field of the Invention

The invention is directed to a rotor of a turbomachine.

2. Detailed Description of Related Art

A rotor of a turbomachine, particularly of a gas turbine or steam turbine, has a main rotor body and a plurality of rotor blades which are fastened to the main rotor body. The rotor blades of a turbomachine rotor of this kind have a blade root and a blade body. Every rotor blade is fastened by its blade root to the main rotor body, and every rotor blade has in the region of its blade body at least one coupling element segment constructed as an outer shroud segment when this coupling element segment is positioned on the radially outer side of the blade body. The coupling element segments, particularly the outer shroud segments, of all of the rotor blades of a turbomachine rotor of this kind form at least one circumferentially closed coupling element, particularly an outer shroud, of the rotor.

Considered in circumferential direction of a turbomachine rotor, a width of a coupling element segment, particularly of an outer shroud segment, of every rotor blade is defined by edges extending substantially in axial direction. A depth in axial direction of the coupling element segment, particularly of the outer shroud segment, of every rotor blade is defined by edges extending substantially in circumferential direction. Aside from the width in circumferential direction and the depth in axial direction, a coupling element segment, particularly an outer shroud segment, of every rotor blade is also characterized by a thickness in radial direction.

Turbomachine rotors whose rotor blades have coupling element segments of the type mentioned above for forming at least one coupling element can be installed in the region of the compressor as well as in the region of a turbine of the turbomachine.

Turbomachine rotors having rotor blades that are fastened to their main rotor body and that have, at the radially outer side of the blade body, a coupling element segment formed as an outer shroud segment are known, for example, from DE 1 159 965 C, DE 40 15 206 C1, U.S. Pat. No. 4,400,915 A, and GB 2 072 760 A.

The coupling elements of turbomachine rotors of the type mentioned above formed as outer shrouds are particularly exposed to high loads in operation because they rotate at maximum radius with respect to an axis of rotation of the turbomachine rotor and are therefore subject to high centrifugal forces. As a result of the centrifugal load, corners and edges of the coupling element segments of the rotor blades can bend outward so that on the one hand stress peaks are caused in the coupling element and on the other hand a desirable contact between adjacent coupling element segments of adjacent rotor blades is reduced to punctiform contact or disappears entirely, which reduces or eliminates a desired coupling between adjacent coupling element segments so that the vibration behavior of the turbomachine rotor eventually deteriorates.

SUMMARY OF THE INVENTION

An object of the present invention is a rotor of a turbomachine in which a good coupling of the coupling element segments of the rotor blades is ensured during operation.

According to one embodiment of the invention, viewed from radially outside, the coupling element segment, or every coupling element segment, of every rotor blade is contoured such that at a first side to which a coupling element segment of a first directly adjacent rotor blade is connected considered in circumferential direction that, adjacent on the flow inlet side to a flow inlet edge of the blade body of the respective rotor blade, the radially outer edge of the respective coupling element segment, which radially outer edge extends substantially in axial direction, projects outwardly in circumferential direction beyond the radially inner edge of the respective coupling element segment, which radially inner edge extends substantially in axial direction, whereas, at this first side facing away on the flow outlet side from a flow outlet edge of the blade body of the respective rotor blade, the radially inner edge extending substantially in axial direction projects outwardly beyond the radially outer edge extending substantially in axial direction.

According to one embodiment of the invention, the coupling element segment, or every coupling element segment, of every rotor blade is contoured such that at a second side located opposite the first side, to which second side a coupling element segment of a second directly adjacent rotor blade is connected considered in circumferential direction, that adjacent on the flow outlet side to the flow outlet edge of the blade body of the respective rotor blade, the radially outer edge of the respective coupling element segment, which radially outer edge extends substantially in axial direction, projects outwardly in circumferential direction beyond the radially inner edge of the respective coupling element segment, which radially inner edge extends substantially in axial direction, whereas, at this second side facing away on the flow inlet side from the flow inlet edge of the blade body of the respective rotor blade, the radially inner edge extending substantially in axial direction projects outwardly beyond the radially outer edge extending substantially in axial direction.

With the rotor, according to one embodiment of the invention, of a turbomachine, an optimal support and, therefore, an optimal coupling of the coupling element segments forming the coupling element, or every coupling element, is ensured during operation by the contour of the coupling element segments of the rotor blades at the edges extending substantially in axial direction. In this way, stress peaks in the coupling element of the rotor, or in every coupling element of the rotor, can be appreciably reduced in operation. Further, the resonant frequency behavior and, therefore, the vibration behavior of the rotor can be improved in this way.

At the first and second side, the radially outer edge of the respective coupling element segment, which radially outer edge extends substantially in axial direction, and the radially inner edge of the respective coupling element segment, which radially inner edge extends substantially in axial direction, preferably respectively delimit two surfaces which are separated from one another by a separating line having no inflection point, namely, a surface which is concealed when viewed from radially outside and a surface which is visible from radially outside, wherein, at the first side, the surface which is concealed from radially outside is positioned on the flow inlet side and the surface, which is visible from radially outside is positioned on the flow outlet side, and wherein, at the second side, the surface that is concealed from radially outside is positioned on the flow outlet side and the surface that is visible from radially outside is positioned on the flow inlet side, and wherein, at the first side and at the second side of the respective coupling element segment viewed along the respective separating line having no inflection point, the surface concealed from radially outside is inclined relative to the radial direction by a first angle and the surface visible from radially outside is inclined relative to the radial direction by a second angle. This allows an economical manufacture of the turbine rotor according one embodiment of to the invention, namely, the rotor blades thereof, while ensuring an optimal coupling of the coupling element segments.

According to one embodiment of the invention, at the first side and at the second side of the respective coupling element segment considered from radially outside, the radially outer edge extending substantially in axial direction and the radially inner edge extending substantially in axial direction are congruent at exclusively one axial position. This feature also ensures that the rotor blades of the rotor can be manufactured in a simple manner while ensuring an optimal coupling of the coupling element segments.

BRIEF DESCRIPTION OF THE DRAWINGS

Examples of the invention will be described in more detail with reference to the drawings without the invention being limited to these embodiment examples In the drawings.

DETAILED DESCRIPTION OF THE PREFERRED EMBODIMENTS

Figure 1:
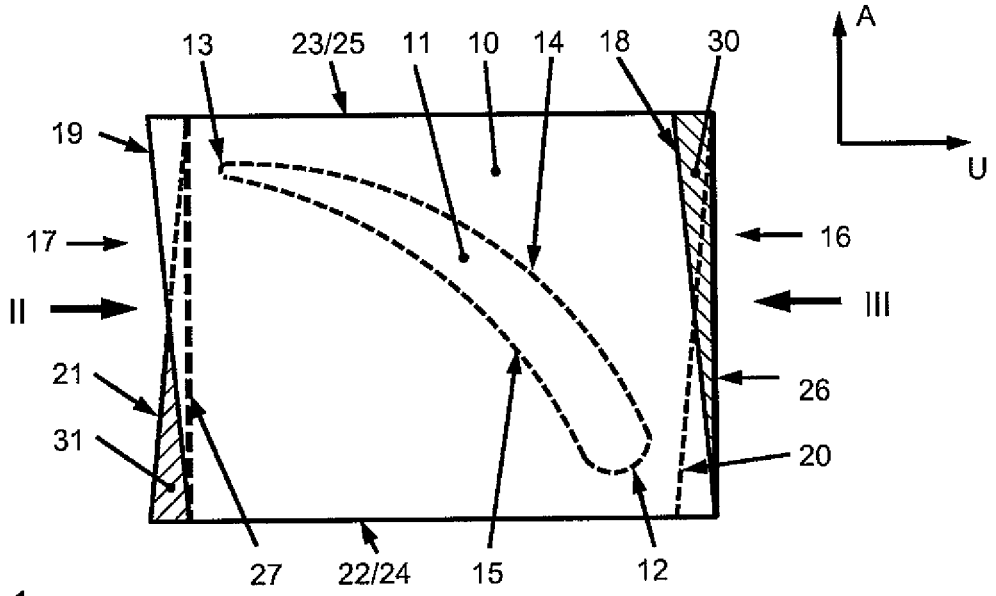
FIG. 1 is a schematic top view of a rotor blade having a coupling element segment constructed as an outer shroud segment of a rotor, according to the invention, of a turbomachine viewed from radially outside according to a first embodiment example of the invention.
Figure 2:
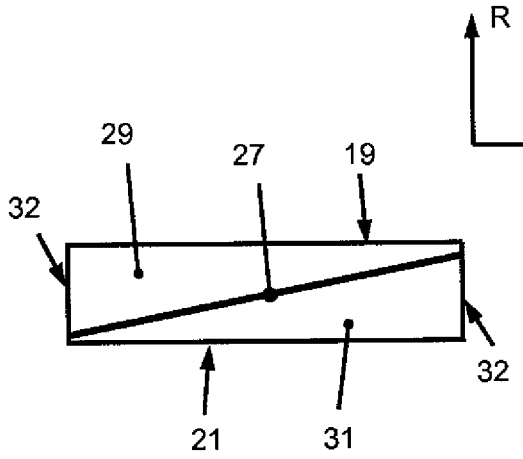
FIG. 2 is a schematic side view of the outer shroud segment of the rotor blade of FIG. 1 considered in circumferential viewing direction II of FIG. 1.
Figure 3:
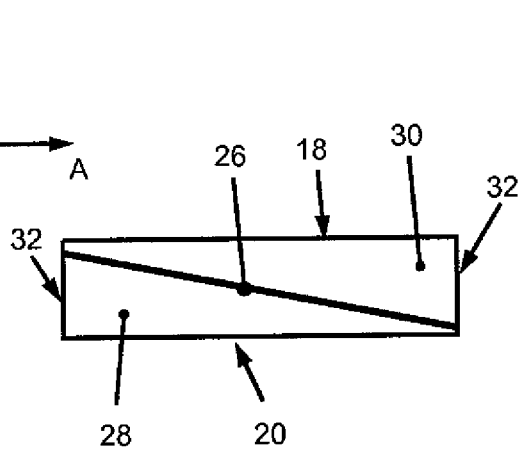
FIG. 3 is another schematic side view of the outer shroud segment of the rotor blade of FIG. 1 considered in circumferential viewing direction III of FIG. 1.
Figure 4:
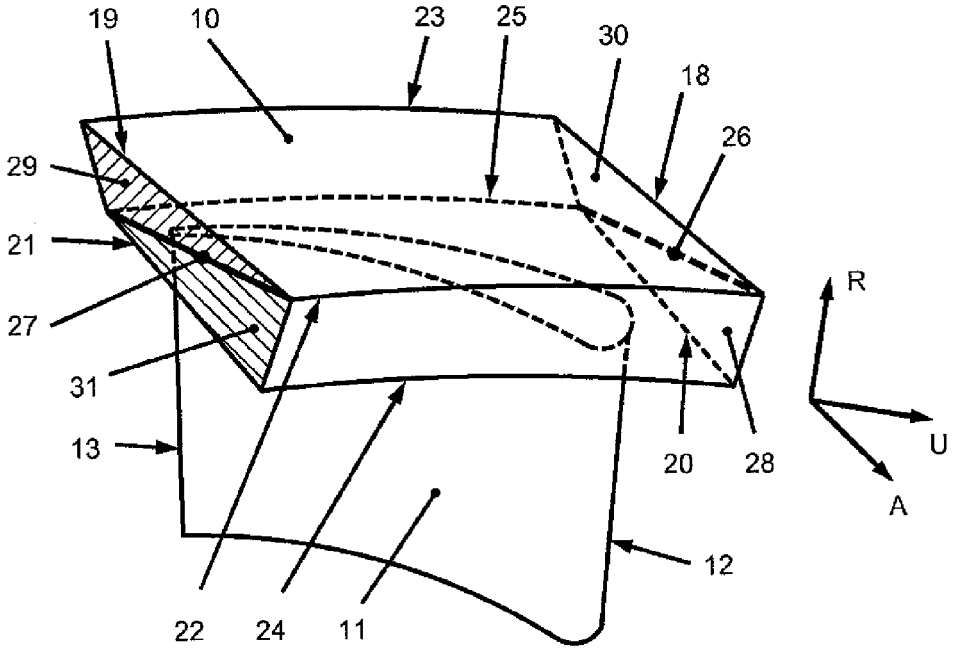
FIG. 4 is a perspective view of the rotor blade of FIG. 1.
Figure 5:
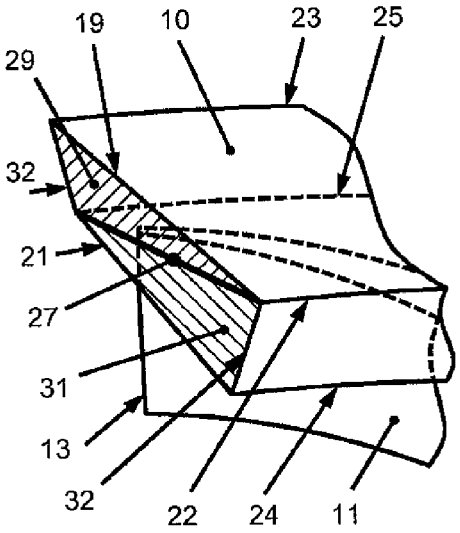
FIG. 5 is a section from the perspective view of FIG. 2 considered in circumferential viewing direction II of FIG. 1.
Figure 6:
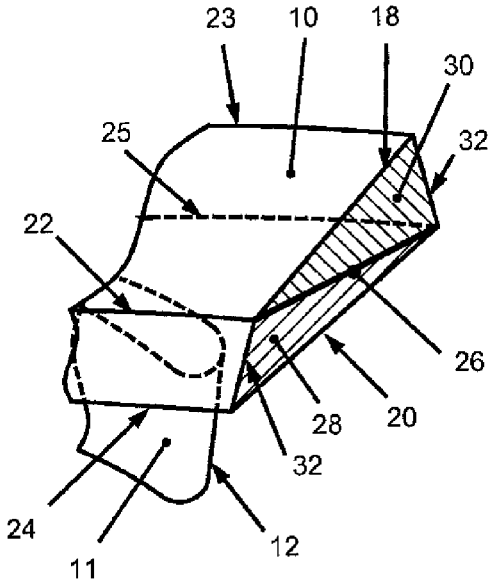
FIG. 6 is another section from the perspective view of FIG. 2 considered in circumferential viewing direction III of FIG. 1.

The present invention is directed to a rotor of a turbomachine, particularly a rotor of a compressor or of a turbine of a turbomachine constructed as a gas turbine or steam turbine. However, the invention is not limited to these applications; rather, the invention can be put to use in all turbomachine rotors.

A rotor of a turbomachine basically has a main rotor body and a plurality of rotor blades which are fastened by blade roots to the main rotor body. The main rotor body and the blade roots of rotor blades are not shown in detail in FIGS. 1 to 8 because those skilled in the art will be familiar with these details.

FIGS. 1 to 6 show different views of a detail of a rotor of a turbomachine according to a first embodiment of the invention. Different views of a coupling element segment 10 formed as an outer shroud segment are shown in FIGS. 1 to 6. As can be seen best from FIGS. 4 to 6, the outer shroud segment 10 is associated with a radially outer end of a blade body 11 of a rotor blade. The blade body 11 has a flow inlet edge 12, a flow outlet edge 13, and a suction side 14 and pressure side 15 extending between the flow inlet edge 12 and the flow outlet edge 13.

A radial direction R, a circumferential direction U and an axial direction A of the outer shroud segment 10 and of the blade body 11 and, therefore, of a rotor blade and of a rotor, according to the invention, of the turbomachine are indicated by arrows in FIGS. 1, 2, 3 and 4.

The outer shroud segment 10, which is associated with the blade body 11 radially outwardly, has a width defined by edges extending substantially in axial direction A. Accordingly, a radially outer edge 18 and 19, respectively, extending substantially in axial direction A and radially inner edges 20 and 21, respectively, which likewise extend substantially in axial direction A extend, respectively, at two opposite sides 16 and 17 of the outer shroud segment 10. The distance between this radially outer edge 18 and 19, respectively, and this radially inner edge 20 and 21, respectively, determines the thickness of the outer shroud segment 10 at sides 16 and 17 in radial direction R.

A depth in axial direction A of the outer shroud segment 10 is defined by edges extending substantially in circumferential direction U, namely by radially outer edges 22 and 23, respectively, and radially inner edges 24 and 25, respectively. Edges 22 and 24 are edges on the flow inlet side, and edges 23 and 25 are edges on the flow outlet side. Also, the distance between these edges determines the thickness of the outer shroud segment 10 in radial direction R, namely, on the flow inlet side and flow outlet side.

Viewed from radially outside, the outer shroud segment 10 of every rotor blade is contoured such that the region of a first side 16 at which an outer shroud segment of a first directly adjacent rotor blade adjoins a second side thereof in circumferential direction U that, adjacent on the flow inlet side to the flow inlet edge 12 of the blade body 11 of the respective rotor blade, the radially outer edge 18 of the outer shroud segment 10, which radially outer edge 18 extends substantially in axial direction A, projects outwardly in circumferential direction U beyond the radially inner edge 20 of the outer shroud segment 10, which radially inner edge 20 extends substantially in axial direction A, whereas at this first side 16 facing the flow outlet edge 13 on the flow outlet side, the radially inner edge 20 of the outer shroud segment 10, which radially inner edge 20 extends substantially in axial direction A, projects outwardly in circumferential direction U beyond the radially outer edge 18 which likewise extends substantially in axial direction A.

At the opposite, second side 17 of the outer shroud segment 10 to which is connected a directly adjacent second rotor blade by its outer shroud segment, namely by a first side thereof, the contour of this outer shroud segment is carried out in such a way that, adjacent on the flow outlet side to the flow outlet edge 13 of the blade body 11, the radially outer edge 19 of the outer shroud segment 10 extending substantially in axial direction A projects outwardly in circumferential direction U beyond the radially inner edge 21 which likewise extends substantially in axial direction A, whereas in this second side 17 facing away from the flow inlet edge 12 on the flow inlet side, the radially inner edge 21 extending substantially in axial direction A projects outwardly in circumferential direction U beyond the radially outer edge 19 which likewise extends substantially in axial direction A.

As a result of the contouring of the outer shrouds 10 of every rotor blade of the turbomachine rotor, an optimal coupling of adjacent outer shroud segments 10 can be ensured in operation so that the resonant frequencies and, therefore, the vibration behavior of the rotor, particularly in the region of the outer shroud comprising individual outer shroud segments 10, are influenced in a positive manner.

At the first side 16 of the outer shroud segment 10 which faces the flow inlet edge 12 of the blade body 11 and faces away from the flow outlet edge 13 of the same, and at the second side 17 of the outer shroud segment 10, which faces toward the flow inlet edge 13 of the blade body 11 and faces away from the flow inlet edge 12, the radially outer edges 18 and 19, respectively, which extend substantially in axial direction A, together with the radially inner edges 20 and 21, respectively, which likewise extend substantially in axial direction A, respectively delimit two surfaces which are separated from one another by a separating line 26 and 27, respectively, namely, a surface 28 and 29, respectively, which is concealed considered from radially outside and a surface 30 and 31, respectively, which is visible viewed from radially outside.

At the first side 16 of the outer shroud segment 10, the surface 28 which is concealed from radially outside is positioned on the flow inlet side and the surface 30, which is visible from radially outside is positioned on the flow outlet side. In the region of the opposite second side 17 of the outer shroud segment 10, on the other hand, the surface 29 which is concealed from radially outside is positioned on the flow outlet side and the surface 31 which is visible from radially outside is positioned on the flow inlet side.

According to a preferred embodiment of the invention, the separating lines 26 and 27 which separate the surfaces 28 and 30 and surfaces 29 and 31 from one another, respectively, at the first side 16 and at the second side 17 are constructed without an inflection point, these separating lines 26 and 27 extending in a straight line in the embodiment example shown in FIGS. 1 to 6. This allows an especially simple manufacture. The edges 18, 19, 20 and 21 extending substantially in axial direction A are likewise constructed without an inflection point.

In the embodiment example in FIGS. 1 to 6, the separating line 26 of the first side 16 is visible viewed from radially outside, whereas the separating line 27 of the second side 17 is concealed considered from radially outside. According to FIGS. 2, 3 and 4, the separating lines 26 and 27 of the two sides 16, 17 run from the radially outer side to the radially inner side, respectively, proceeding from edges on the flow inlet side to edges on the flow outlet side.

In the area of the first side 16 of the outer shroud segment 10 and of the opposite, second side 17 of the outer shroud segment 10, the surfaces 28 and 29, respectively, which are concealed viewed from radially outside and the surfaces 30 and 31, respectively, which are visible viewed from radially outside are inclined by an angle relative to the radial direction R considered along the respective separating line 26 and 27. The surfaces 28 and 29, respectively, which are concealed from radially outside are inclined relative to the radial direction R by a first angle, and the surfaces 30 and 31, respectively, which are visible from radially outside are inclined relative to the radial direction R by a second angle.

At the first side 16 and second side 17, the first angle and second angle are preferably identical with respect to degree but have different mathematical signs. This is particularly advantageous in technical respects relating to manufacture. In contrast, however, it is also possible that the first angle and the second angle at the first side 16 and second side 17 differ in degrees but again have different mathematical signs.

According to one embodiment of the invention, the surfaces 28 and 29, respectively, which are concealed from radially outside and the surfaces 30 and 31, respectively, which are visible from radially outside have a surface ratio of 1:1 at the first side 16 of the outer shroud segment 10 and at the second side 17 of the outer shroud segment 10, which means that the surfaces 28 and 29, respectively, which are concealed from radially outside and the surfaces 30 and 31, respectively, which are visible from radially outside are identically dimensioned at the two sides 16 and 17. Let it be noted that these surfaces can also be differently dimensioned at the first side 16 and at the second side 17. Accordingly, it is possible that the surfaces 28 and 29, respectively, which are concealed from radially outside and the surfaces 30 and 31, respectively, which are visible from radially outside have a surface ratio of up to 1:5 or up to 5:1, particularly a surface ratio of up to 1:3 or up to 3:1, at the first side 16 and/or at the second side 17.

By deliberately increasing or decreasing the surface ratio between the surface 28 and 29, respectively, which is concealed from radially outside and the surface 30 and 31, respectively, which is visible from radially outside at sides 16 and 17, it is possible to adjust the desired coupling between the outer shroud segments 10 of adjacent rotor blades in an optimal manner. This can also be carried out by the above-mentioned angles which are enclosed by these surfaces with the respective separating line 26 and 27, respectively.

As can be seen most clearly from FIG. 1, viewed from radially outside at the first side 16 and at the second side 17 of the outer shroud segment 10, the radially outer edge 18 and 19, respectively, extending substantially in axial direction A and the radially inner edge 20 and 21, respectively, extending substantially in axial direction A are congruent exclusively at one axial position. In the embodiment example of FIGS. 1 to 6, this axial position is positioned approximately in the middle between the edges 22 and 24, respectively, of the outer shroud segment 10 on the flow inlet side and edges 23 and 25, respectively, of the outer shroud segment 10 on the flow outlet side.

Figure 7:
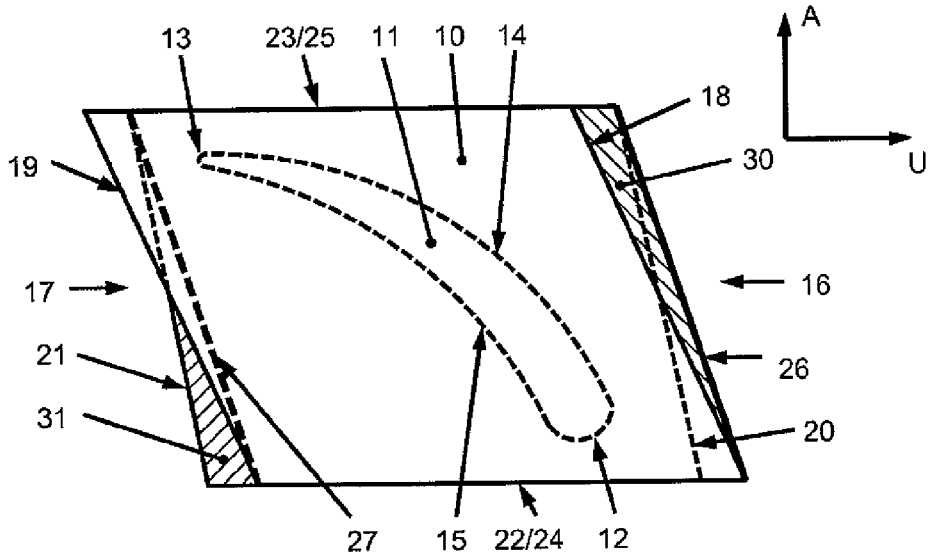
FIG. 7 is a schematic top view of a rotor blade having a coupling element segment constructed as an outer shroud segment of a rotor, of a turbomachine viewed from radially outside according to a second embodiment example of the invention.
Figure 8:
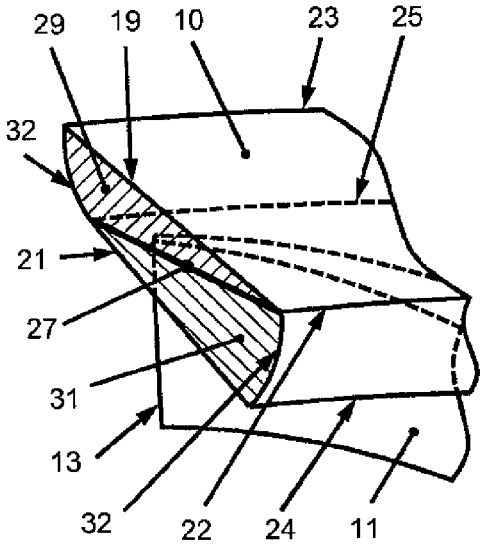
FIG. 8 is a section from the second embodiment example of FIG. 7 analogous to the section from FIG. 5.
Figure 9:
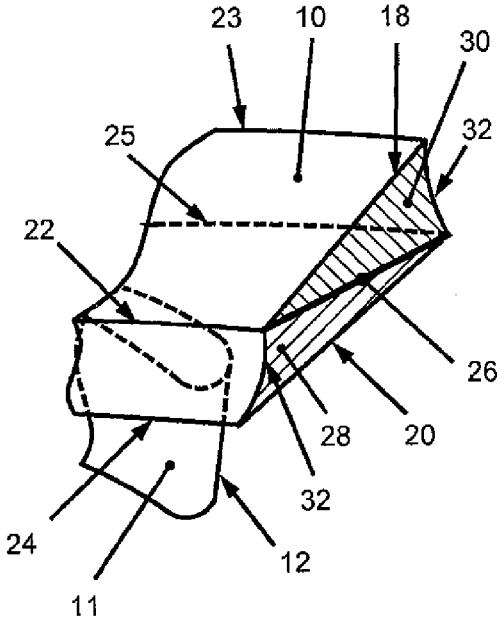
FIG. 9 is a section from the second embodiment example of FIG. 7 analogous to the section from FIG. 6.

As can be gathered from FIGS. 7 to 9, by correspondingly inclining the edges 18, 20 and 19, 21 in the area of sides 16 and 17 relative to the axial direction A, this axial position at which edges 18 and 20 and edges 19 and 21 are congruent can also be shifted relative to the center between the edges 22, 24 of the outer shroud segment 10 on the flow inlet side and edges 23, 25 of the outer shroud segment 10 on the flow outlet side; in FIG. 7, this axial position is positioned closer to the edges 23, 25 on the flow outlet side. In contrast, it is also possible to position this axial position closer to the edges 22, 24 on the flow inlet side.

In the embodiment shown in FIGS. 1 to 6, the surfaces 28, 29, respectively, which are concealed from radially outside and the surfaces 30, 31, respectively, which are visible from radially outside, which surfaces 28, 29, respectively, and 30, 31, respectively, are formed in the area of the first side 16 and the second side 17 of the outer shroud segment 10, are in each instance constructed as two-dimensionally contoured, plane surfaces. On the other hand, FIGS. 7 to 9 show an embodiment of the present invention in which these surfaces 28, 29, 30 and 31 are constructed as three-dimensionally contoured, spatially radially curved surfaces.

Accordingly, it can be seen from FIGS. 7 to 9 that edges 32, which extend substantially in radial direction and which delimits the outer shroud segment 10 together with edges 18, 19, 20, 21, 22, 23, 24 and 25 are not contoured in a straight line but rather so as to be radially curved in contrast to the embodiment example in FIGS. 1 to 6.

Regarding the remaining details, the embodiment in FIGS. 7 to 9 corresponds to the embodiment example in FIGS. 1 to 6 so that the same reference numerals are used for the same assemblies and reference is had to the above statements.

Figure 10:
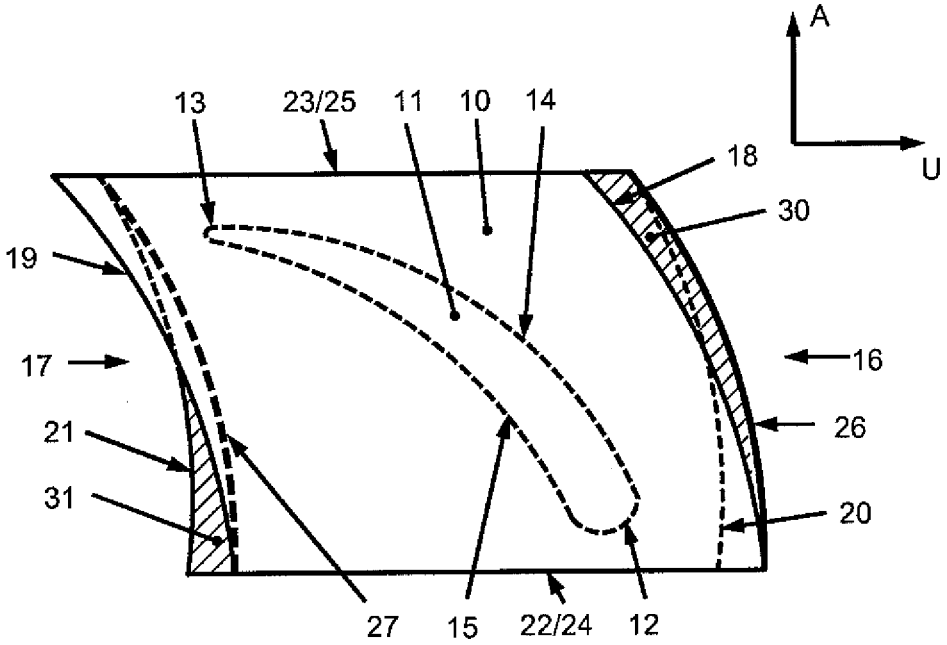
FIG. 10 is a schematic top view of a rotor blade having a coupling element segment constructed as an outer shroud segment of a rotor of a turbomachine viewed from radially outside according to a third embodiment example of the invention.
Figure 11:
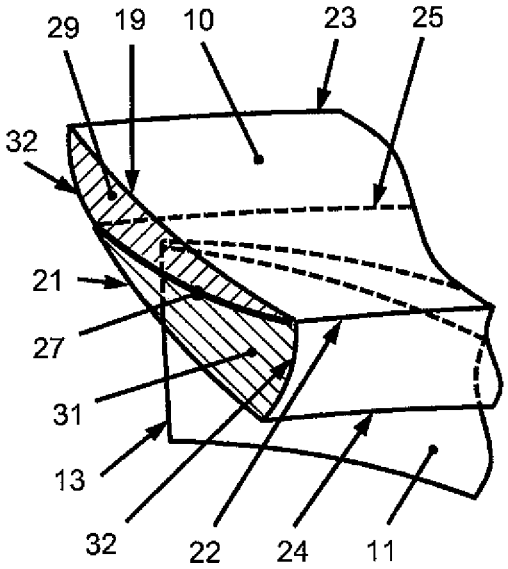
FIG. 11 is a section from the third embodiment example of FIG. 10 analogous to the section from FIGS. 5 and 8.
Figure 12:
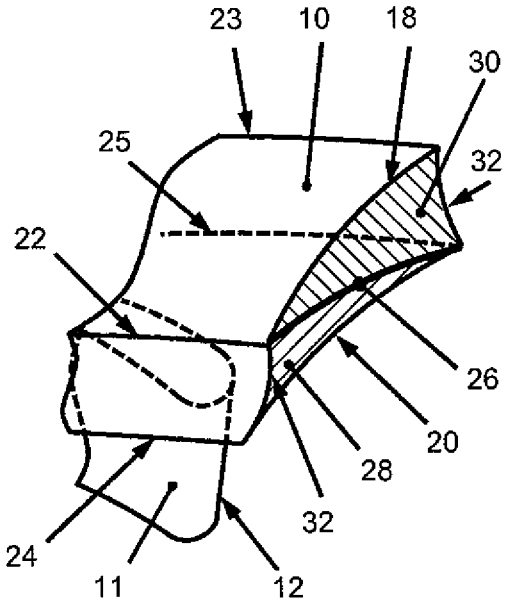
FIG. 12 is a section from the third embodiment example of FIG. 10 analogous to the section from FIGS. 5 and 9.

FIGS. 10 to 12 show a third embodiment of the invention in which the radially outer edges 18 and 19 and the radially inner edges 20 and 21 that extend substantially in axial direction A and define the width of the outer shroud segment 10 in circumferential direction U each have a curved contour or extend in a curved manner but without an inflection point at both opposite sides 16 and 17 in the same way as the separating lines 26, 27. The embodiment example in FIGS. 10 to 12 corresponds to the embodiment example in FIGS. 7 to 9 with respect to the rest of the details, so that the same reference numerals are used for the same assemblies and the above statements may be referred to for this embodiment example also.

Figure 13:
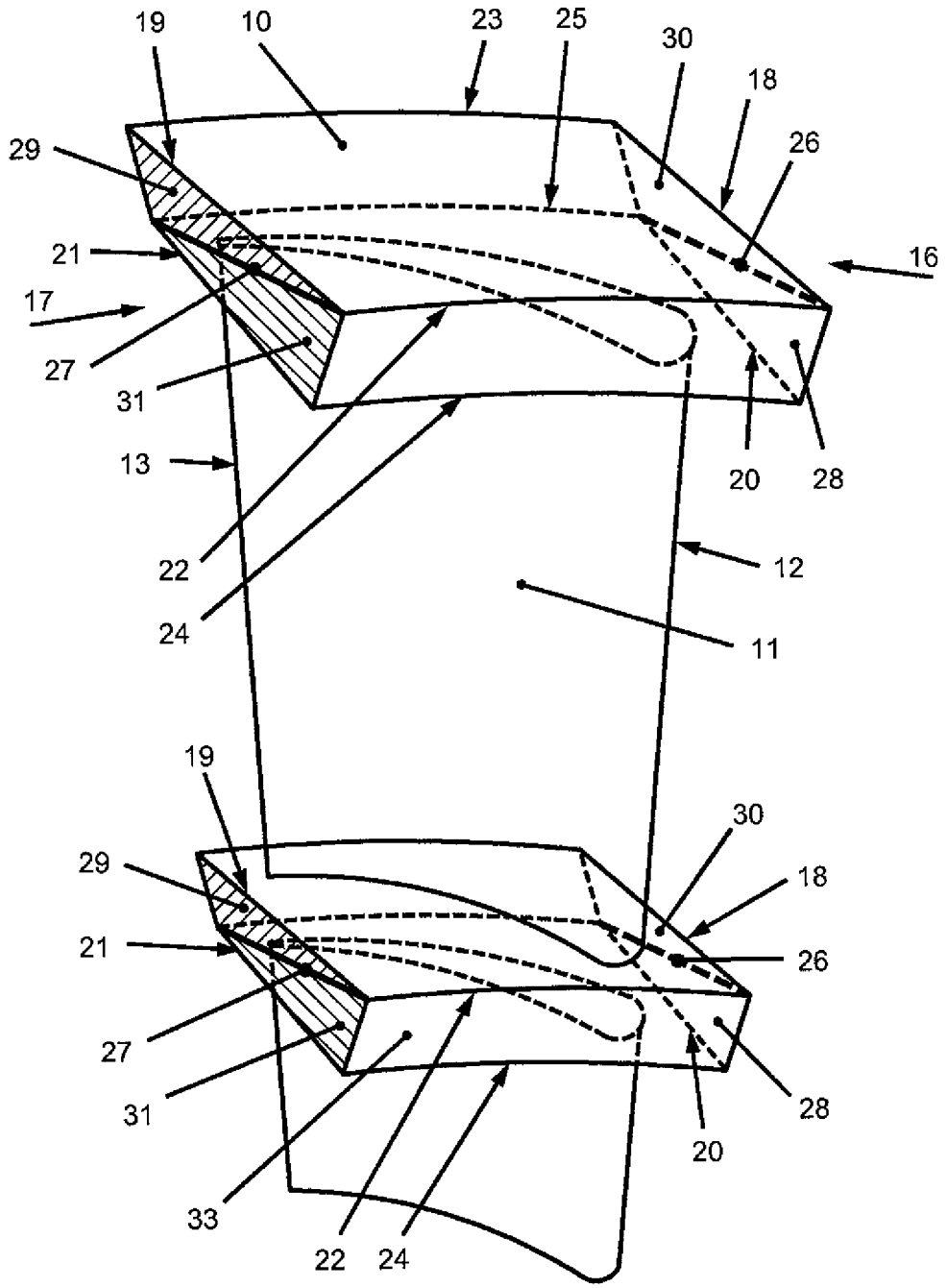
FIG. 13 is a perspective view of a rotor blade having a coupling element segment constructed as an outer shroud segment and another coupling element segment constructed as an inner coupling element segment of a rotor of a turbomachine viewed from radially outside according to a fourth embodiment example of the invention.
Figure 14:
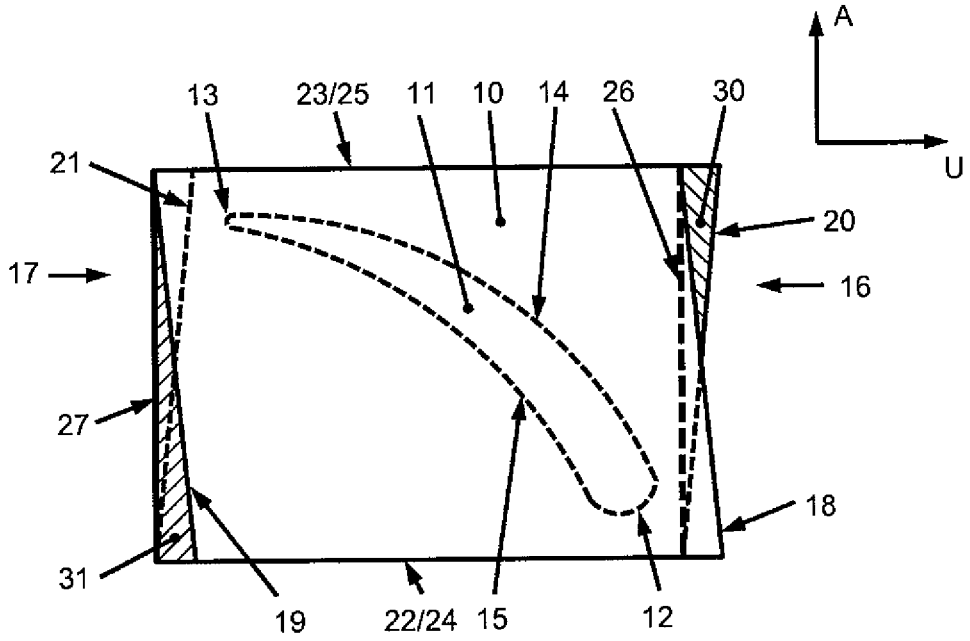
FIG. 14 is a schematic top view of a rotor blade having a coupling element segment constructed as an outer shroud segment of a rotor of a turbomachine viewed from radially outside according to a fifth embodiment example of the invention.
Figure 15:
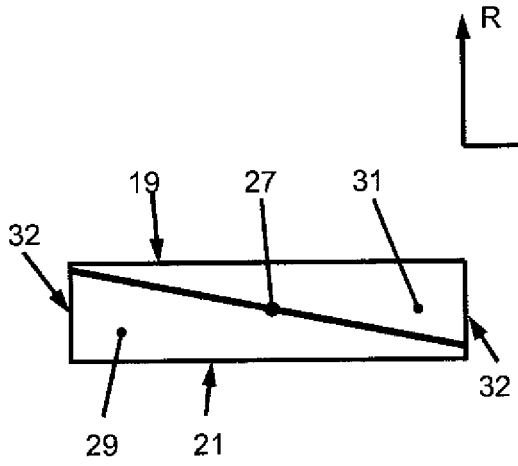
FIG. 15 is a view of the embodiment example of FIG. 14 analogous to FIG. 2.
Figure 16:
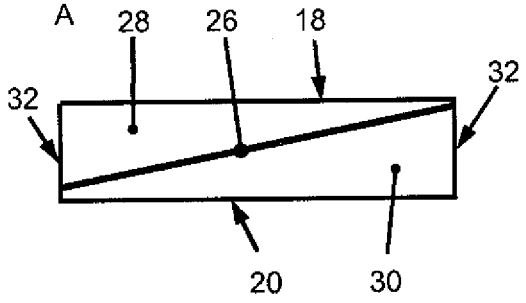
FIG. 16 is a view of the embodiment example of FIG. 14 analogous to FIG. 3.
Figure 17:
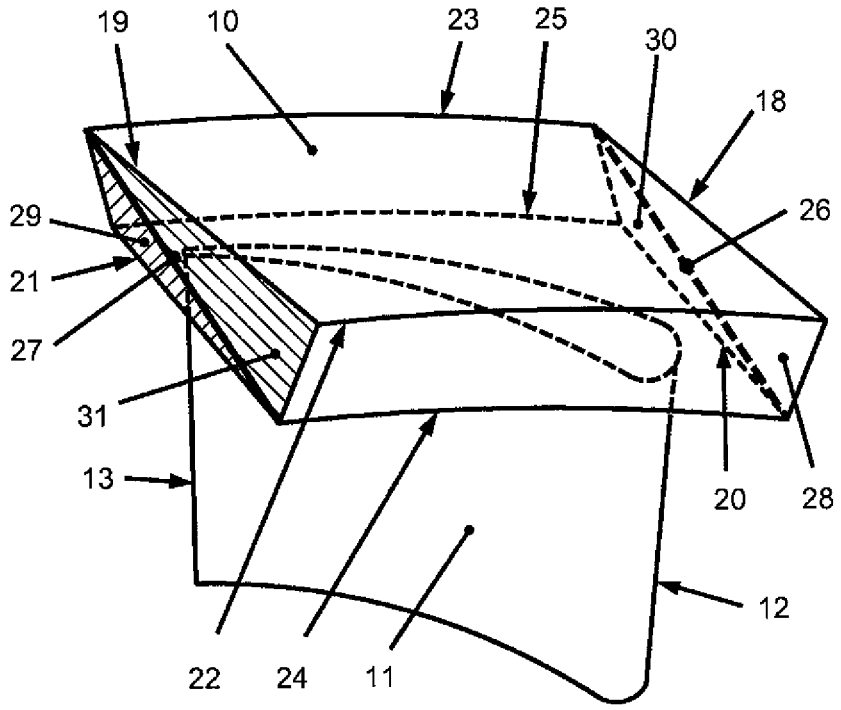
FIG. 17 is a view of the embodiment example of FIG. 14 analogous to FIG. 4.

FIG. 13 shows another embodiment in which not only a coupling element segment formed as outer shroud segment 10 but also, in addition, a coupling element segment formed as an inner coupling element segment 33 is associated with the blade body 11 of the rotor blade of the rotor according to the invention that is shown. The outer shroud segment 10 and the inner coupling element segment 33 of the embodiment example in FIG. 13 are formed in a manner analogous to the outer shroud segment 10 of the embodiment example in FIGS. 1 to 6. However, they can also be constructed like the outer shroud segments 10 of the embodiment examples in FIGS. 7 to 9 or in FIGS. 10 to 12. Further, the shown rotor blade can have a plurality of inner coupling element segments 33 which are spaced apart in radial direction.

Further, it is possible that no outer shroud segment 10 but rather exclusively at least one coupling element segment formed as an inner coupling element segment 33 is associated with the rotor blade of a rotor according to the invention.

The inner coupling element segment 33, or every inner coupling element segment 33, is preferably positioned at a radial position along the radial blade length of the respective blade body 11, which radial position corresponds to between 40% and 90%, particularly 60% and 90%, of the radial blade length. On the other hand, outer shroud segments 10 lie at a radial position along the radial blade length of the respective blade body 11, which corresponds to 100% of the radial blade length.

FIGS. 14 to 17 show another embodiment of the invention. The embodiment in FIGS. 14 to 17 substantially corresponds to the embodiment example of FIGS. 1 to 6 so that, in this case also, to avoid needless repetition, the same reference numerals are used for the same assemblies and only the details which distinguish the embodiment of the invention in FIGS. 14 to 17 from that in FIGS. 1 to 6 will be discussed in the following. Accordingly, in the embodiment example of FIGS. 14 to 17, the separating line 26 of the first side 16 is concealed considered from radially outside, whereas the separating line 27 of the second side 17 is visible considered from radially outside. According to FIGS. 15, 16 and 17, separating lines 26 and 27 of the two sides 16, 17 extend from radially inside to radially outside proceeding from edges on the flow inlet side to edges on the flow outlet side. The embodiment example in FIGS. 14 to 17 corresponds to the embodiment example in FIGS. 1 to 6 with respect to the rest of the details, so that the above statements may be referred to.

The invention allows an optimal coupling of coupling element segments 10, 33 of adjacent rotor blades during the operation of the rotor. In this way, the resonant frequency behavior and, therefore, the vibration behavior of the rotor, particularly in the region of an outer shroud, are influenced in a positive manner.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A rotor of a turbomachine comprising:

a main rotor body; and a plurality of rotor blades, each rotor blade having:

a blade root, wherein each rotor blade is fastened by its blade root to the main rotor body;

a blade body; and at least one coupling element segment in the region of a blade body, wherein a width of the coupling element segment of each rotor blade is defined in circumferential direction by edges extending substantially in axial direction, wherein viewed from radially outside, the at least one coupling element segment, of every rotor blade is contoured such that at a first side to which a coupling element segment of a first directly adjacent rotor blade is connected considered in circumferential direction and adjacent to a flow inlet side a flow inlet edge of the blade body of the respective rotor blade a radially outer edge of the coupling element segment, which radially outer edge extends substantially in axial direction, projects outwardly in circumferential direction beyond a radially inner edge of the respective coupling element segment, the radially inner edge extends substantially in axial direction, whereas, at the first side facing away from the flow outlet side from a flow outlet edge of the blade body of the respective rotor blade, the radially inner edge extending substantially in axial direction projecting outwardly in circumferential direction beyond the radially outer edge extending substantially in axial direction, and the coupling element segment of each rotor blade is contoured such that a second side located opposite the first side, to which second side the coupling element segment of a second directly adjacent rotor blade is connected considered in circumferential direction, adjacent on the flow outlet side to the flow outlet edge of the blade body of the rotor blade, the radially outer edge of the respective coupling element segment extends substantially in axial direction and projects outwardly in circumferential direction beyond the radially inner edge of the respective coupling element segment, the radially inner edge extends substantially in axial direction, whereas, at the second side facing away on the flow inlet side from the flow inlet edge of the blade body of the respective rotor blade, the radially inner edge extending substantially in axial direction projects outwardly in circumferential direction beyond the radially outer edge extending substantially in the axial direction, and wherein the radially inner edge of the respective coupling element segment extends substantially in the axial direction, respectively, delimits two surfaces which are separated from one another by a straight separating line, configured as a surface which is concealed considered from radially outside and a surface which is visible considered from radially outside, wherein, at the first side and at the second side of each coupling element segment, the separating lines which, at the first side and at the second side, separate the surface which is concealed from radially outside from the surface which is visible from radially outside are formed without an inflection point, wherein, at the first side and at the second side of the respective coupling element segment viewed along the separating lines, the surface that is concealed from radially outside is inclined relative to the radial direction by a first angle and the surface which is visible from radially outside is inclined relative to the radial direction by a second angle.

2. The rotor according to claim 1, wherein at the first side and at the second side, the radially outer edge of the respective coupling element segment, the radially outer edge extends substantially in axial direction, and wherein, at the first side, the surface which is concealed from radially outside is positioned on the flow inlet side and the surface which is visible from radially outside is positioned on the flow outlet side, and wherein, at the second side, the surface which is concealed from radially outside is positioned on the flow outlet side and the surface which is visible from radially outside is positioned on the flow inlet side.

3. The rotor according to claim 1, wherein, at the first side and at the second side of each respective coupling element segment, the first angle and second angle are identical with respect to degree and have different mathematical signs.

4. The rotor according to claim 1, wherein, at the first side and at the second side of each respective coupling element segment, the first angle and the second angle differ in degree and have different mathematical signs.

5. The rotor according to claim 1, wherein, at the first side and at the second side of each respective coupling element segment, the surfaces concealed from radially outside and the surfaces visible from radially outside are identically dimensioned and have a surface ratio of 1:1.

6. The rotor according to claim 4, wherein, at the first side and at the second side of each respective coupling element segment, the surfaces concealed from radially outside and the surfaces visible from radially outside have different dimensions.

7. The rotor according to claim 6, wherein, at the first side and at the second side, the surfaces concealed from radially outside and the surfaces visible from radially outside have a surface ratio of at least 1:5 and up to 5:1.

8. The rotor according to claim 7, wherein, at the first side and at the second side of the respective coupling element segment, the surfaces concealed from radially outside and the surfaces visible from radially outside are each two-dimensionally contoured, plane surfaces.

9. The rotor according to claim 7, wherein, at the first side and at the second side, the surfaces concealed from radially outside and the surfaces visible from radially outside are each three-dimensionally contoured, spatially curved surfaces.

10. The rotor according to one of claim 9, wherein at least at one of the first side and at the second side of the respective coupling element segment considered from radially outside, the radially outer edge extending substantially in axial direction and the radially inner edge extending substantially in axial direction have a same radial length at a point where the inner and outer sides cross.

11. The rotor according to claim 10, wherein, at the first side and at the second side, this axial position is positioned in the middle between edges of the coupling element segment on the flow inlet side and edges of the coupling element segment on the flow outlet side.

12. The rotor according to claim 10, wherein, at the first side and at the second side, this axial position is positioned one of closer to edges of the coupling element segment on the flow inlet side and closer to edges of the coupling element segment on the flow outlet side.

13. The rotor according to claim 1, wherein each rotor blade has a coupling element segment constructed as outer shroud segment radially outwardly in the area of the blade body.

14. The rotor according to one of claim 1, wherein every rotor blade has in the area of the blade body thereof a coupling element segment constructed as inner coupling element segment.

15. The rotor according to claim 7, wherein, at the first side and at the second side, the surfaces concealed from radially outside and the surfaces visible from radially outside have a surface ratio of 1:3 and up to 3:1.

* * * * *